US009136573B2

(12) United States Patent
Ferrari et al.

(10) Patent No.: US 9,136,573 B2
(45) Date of Patent: Sep. 15, 2015

(54) TUNABLE HIGH-FREQUENCY TRANSMISSION LINE

(75) Inventors: Philippe Ferrari, Sonnaz (FR); Gustavo Pamplona Rehder, Sao Paulo (BR)

(73) Assignee: Universite Joseph Fourier (FR)

( * ) Notice: Subject to any disclaimer, the term of this patent is extended or adjusted under 35 U.S.C. 154(b) by 257 days.

(21) Appl. No.: 13/821,865

(22) PCT Filed: Sep. 8, 2011

(86) PCT No.: PCT/FR2011/052058

§ 371 (c)(1),
(2), (4) Date: Jun. 10, 2013

(87) PCT Pub. No.: WO2012/032269

PCT Pub. Date: Mar. 15, 2012

(65) Prior Publication Data

US 2013/0249653 A1 Sep. 26, 2013

(30) Foreign Application Priority Data

Sep. 8, 2010 (FR) ..... 10 57136

(51) Int. Cl.
*H01P 1/00* (2006.01)
*H01P 3/00* (2006.01)
*H01P 1/18* (2006.01)

(52) U.S. Cl.
CPC ..... *H01P 3/003* (2013.01); *H01P 1/184* (2013.01); *H01P 3/006* (2013.01)

(58) Field of Classification Search
None
See application file for complete search history.

(56) References Cited

U.S. PATENT DOCUMENTS

| | | | | |
|---|---|---|---|---|
| 5,406,233 | A * | 4/1995 | Shih et al. | 333/161 |
| 6,377,142 | B1 | 4/2002 | Chiu et al. | |
| 6,498,549 | B1 | 12/2002 | Jiang et al. | |
| 6,950,590 | B2 * | 9/2005 | Cheung et al. | 385/129 |
| 7,148,842 | B1 * | 12/2006 | Crowne et al. | 342/175 |
| 8,138,876 | B2 * | 3/2012 | Ding et al. | 336/200 |
| 8,508,318 | B2 * | 8/2013 | Iwanami | 333/205 |
| 2005/0128029 | A1 | 6/2005 | Lee et al. | |
| 2006/0092079 | A1 * | 5/2006 | de Rochemont | 343/700 MS |
| 2007/0146091 | A1 * | 6/2007 | Narita | 333/12 |
| 2007/0262830 | A1 * | 11/2007 | Gevorgian et al. | 333/109 |
| 2008/0106349 | A1 * | 5/2008 | McKinzie | 333/17.3 |
| 2009/0174499 | A1 * | 7/2009 | Hiramatsu et al. | 333/139 |
| 2009/0251232 | A1 * | 10/2009 | Ding et al. | 333/1 |

(Continued)

FOREIGN PATENT DOCUMENTS

| | | | |
|---|---|---|---|
| EP | 2180541 | A1 | 4/2010 |
| GB | 2406443 | A | 8/2008 |
| WO | 0115260 | A1 | 3/2001 |

OTHER PUBLICATIONS

Jimenez, J., "International Patent Application PCT/FR2011/52058 Written Opinion of the International Searching Authority", Jan. 19, 2012, Publisher: PCT, Published in: FR.

(Continued)

*Primary Examiner* — Lincoln Donovan
*Assistant Examiner* — Khareem E Almo
(74) *Attorney, Agent, or Firm* — Kaplan Breyer Schwarz & Ottesen, LLP

(57) ABSTRACT

The invention relates to a high-frequency transmission line including a central conductive strip (6) associated with at least one conductive shielding plane (4), wherein at least a portion of the space between the conductive plane and the conductive strip comprises a ferroelectric material (10).

6 Claims, 3 Drawing Sheets

(56) References Cited

U.S. PATENT DOCUMENTS

| | | | | |
|---|---|---|---|---|
| 2012/0275123 | A1* | 11/2012 | de Rochemont | 361/748 |
| 2013/0249653 | A1* | 9/2013 | Ferrari et al. | 333/238 |
| 2013/0321093 | A1* | 12/2013 | Ueda et al. | 333/17.3 |
| 2014/0062620 | A1* | 3/2014 | Sun et al. | 333/205 |

OTHER PUBLICATIONS

Jimenez J. Pastor, "International Patent Application No. PCT/FR2011/052058 International Search Report", Jan. 19, 2012, Published in: NL.

* cited by examiner

TUNABLE HIGH-FREQUENCY TRANSMISSION LINE

FIELD OF THE INVENTION

The present disclosure relates to a radio frequency (RF) transmission line. Radio frequency here means the field of millimetric or submillimetric waves, for example, in a frequency range from 10 to 500 GHz.

DISCUSSION OF THE RELATED ART

The continuous development of integrated circuits on silicon opens up possibilities of operation at very high frequency in the radio frequency range. The passive elements used comprise adapters, dimmers, power dividers, and filters. Transmission lines connecting these elements, or forming them, are a basic element in a RF circuit. To exploit the silicon technology, transmission lines on chips having a high quality factor are needed. Indeed, the quality factor is an essential parameter since it represents the insertion losses of a transmission line for a given phase shift. Further, such lines must provide a determined phase shift and have a determined characteristic impedance for the frequency used.

Generally, such transmission lines are formed of a conductive strip having lateral dimensions ranging from 10 to 50 μm and a thickness on the order of one μm (from 0.5 to 5 μm according to the technology used). Such a conductive strip is surrounded by one or several upper or lower lateral conductors forming ground planes intended to form, with the conductive strip, a waveguide type structure. In technologies compatible with the forming of electronic integrated circuits, the conductive strip and the ground planes are formed of elements of metallization levels formed above a semiconductor substrate.

FIG. 1 shows a transmission line formed on an insulating substrate 100. This line comprises a central conductive strip 102 forming the actual transmission line, surrounded with coplanar lateral ground strips 104, 106. This structure is generally called coplanar waveguide or CPW.

Various documents, among which U.S. Pat. No. 6,498,549, have provided making this CPW line tunable by arranging under the line a layer 108 of a ferroelectric material such as BST. However, this solution is not very efficient. Thus, FIG. 12 of U.S. Pat. No. 6,498,549 shows that, at frequencies from 7 to 9 GHz, and for very high electric voltages (greater than 200 V), only phase shifts by a few tens of degrees are obtained, while it would be desirable to obtain significant phase shifts (for example, 180° at 60 GHz for a line length of approximately one millimeter) for voltages compatible with the field of integrated circuits, that is, voltages from 1 to 5 volts. Such a limitation seems to be especially due to the fact that, in practice, it is not possible to deposit BST layers with lower dielectric losses over a thickness greater than 1 μm (400 nm in U.S. Pat. No. 6,498,549).

A particularly high-performance type of transmission line is described in U.S. Pat. No. 6,950,590, having its FIG. 4*a* copied in appended FIG. 2. On a silicon substrate 128 coated with metal levels separated by an insulator 127 is formed a lower shielding plane 136 divided into parallel strips of small width, for example, approximately ranging from 0.1 to 3 μm. In a higher metallization level is formed a central conductive strip 122 forming the actual transmission line, surrounded with coplanar lateral ground strips 124, 126.

Advantages and features of such a line are described in detail in U.S. Pat. No. 6,950,590. As indicated in this patent, the structure forms a slow wave waveguide, currently called S-CPW, for Slow wave CoPlanar Waveguide.

In a structure such as that in FIG. 2, the dimensions of the various elements are optimized to obtain, at a determined frequency, given phase characteristics as well as a given characteristic impedance. It is not possible to modify these characteristics once the line has been formed. For example, it is not possible to form a phase-shifter having a given phase shift identical for several different frequencies, or an impedance matcher enabling to match various impedances.

Thus, prior art provides either CPW lines with a low tuning sensitivity or requiring very high control voltages, or non-tunable S-CPW lines.

SUMMARY

An object of embodiments of the present invention is to provide a transmission line which is finely tunable with control voltages on the order of a few volts.

To achieve this, embodiments of the present invention combine the characteristics of CPW lines tunable with a ferroelectric layer and of S-CPW lines.

Thus, the present invention provides a transmission line of coplanar waveguide type particularly capable of being integrated in microelectronic integrated circuits, wherein various parameters of the waveguide are adjustable to optimize the phase shift at a given frequency and for a selected characteristic impedance, and to modify the line parameters to adapt to a different operating frequency or to a different characteristic impedance.

An embodiment of the present invention provides a high-frequency transmission line comprising a conductive strip associated with at least one conductive shielding plane, wherein at least a portion of the space between the shielding plane and the conductive strip comprises a ferroelectric material.

According to an embodiment of the present invention, the line is of the slow wave coplanar waveguide type comprising two lateral strips extending on either side of the central strip.

According to an embodiment of the present invention, the ferroelectric material extends under all or part of the central strip and of the lateral strips.

According to an embodiment of the present invention, the line is associated with means for selectively biasing (Vbias) the central strip and/or the lateral strips.

According to an embodiment of the present invention, lateral strips have their central portions formed above recesses and are associated with lateral electrostatic displacement means.

BRIEF DESCRIPTION OF THE DRAWINGS

The foregoing and other features and advantages will be discussed in detail in the following non-limiting description of specific embodiments in connection with the accompanying drawings, among which.

It should be noted that generally, as usual in the representation of microelectronic components, the elements of the various drawings are not drawn to scale.

DETAILED DESCRIPTION

Figure 2:
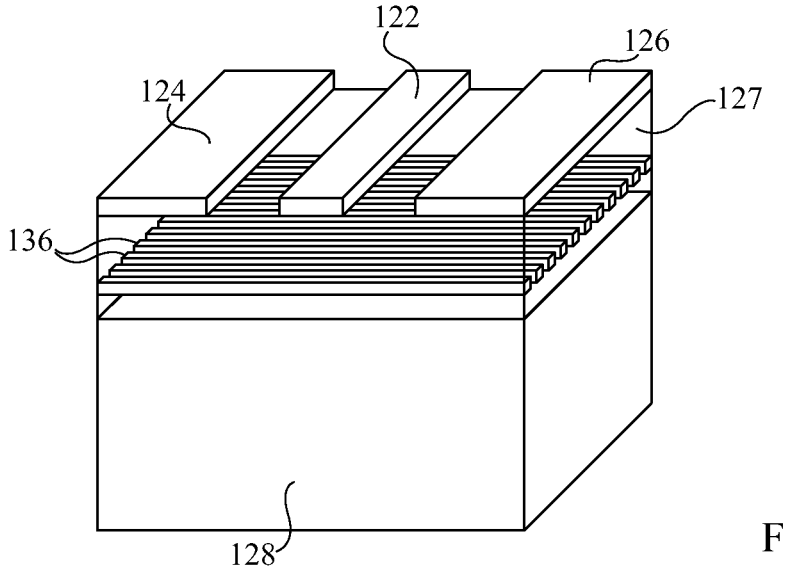
FIG. 2, previously described, is a copy of FIG. 4*a* of U.S. Pat. No. 6,950,590.
Figure 3A:
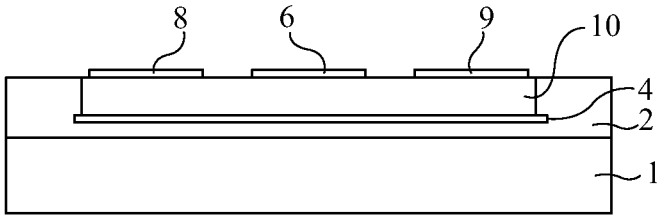
FIGS. 3A, 3B, and 3C respectively are a cross-section view, a perspective view, and a top view of a transmission line according to an embodiment of the present invention.
Figure 3B:
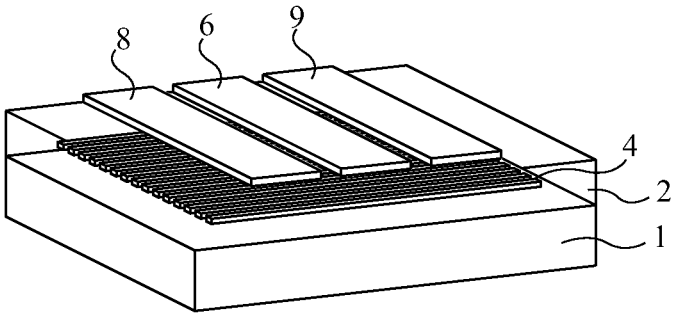
Figure 3C:
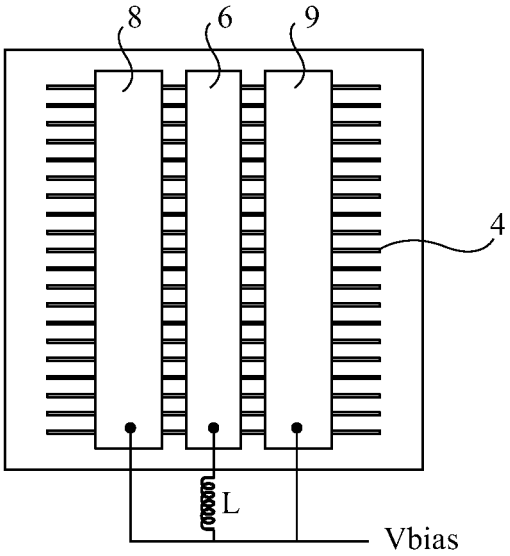

As illustrated in FIGS. 3A, 3B, and 3C, on a substrate 1, for example, a semiconductor substrate, for example, made of silicon, are formed metallization levels separated by an insulating material 2. In a low metallization level is formed a shielding plane divided into microstrips 4 similar to structure 136 of FIG. 2. Above this metallization level is formed a central transmission strip 6 similar to strip 122 and, on either side of this central strip, are formed lateral ground strips 8 and 9 similar to ground strips 124 and 126 of FIG. 2.

As illustrated in FIG. 3A, between strips 6, 8, 9 and shielding plane 4 is arranged a ferroelectric material 10 (ferroelectric material layer 10 has not been shown in FIGS. 3B and 3C for simplification). A ferroelectric material generally has a high dielectric constant, and this dielectric constant may take much higher values if a D.C. electric field is applied. For example, for BST (BaSrTi) having a 300 nm thickness, the dielectric constant varies from 100 to 300 for bias voltages varying from 0 to 5 volts.

It should be noted that the capacitive component between central strip 6 and transverse strips 8 and 9 is negligible if the opposite lateral surfaces of central strip 6 and of lateral strips 8 and 9 are considered. Thus, the capacitive component between central strip 6 and lateral strips 8 and 9 mostly corresponds to the capacitance between the central strip and shielding plane 4 in series with the two capacitances (in parallel) between shielding plane 4 and lateral strips 8 and 9. If these three capacitances have a same value, Cw, the general capacitance will be equal to 2 Cw/3. According to the bias voltage, the general capacitance may vary by a factor on the order of from 1 to 3.

To apply a transverse bias voltage to ferroelectric material layer 10, one may, as illustrated in FIG. 3C, apply a voltage Vbias to each of the lateral strips and to the central strip. To avoid for this bias connection to interfere with the RF signal applied to the central strip, an impedance will be arranged between the bias voltage source and the central strip, preferably an inductance L, but possibly also a resistance of high value.

Further, in an S-CPW structure, the dimensional parameters of the line may be selected so that it operates satisfactorily with a BST thickness between the shielding plane and the conductive strips having a value in the range from 0.3 to 1 μm, which corresponds to the thickness range where a BST layer can in practice be deposited.

Figure 1:
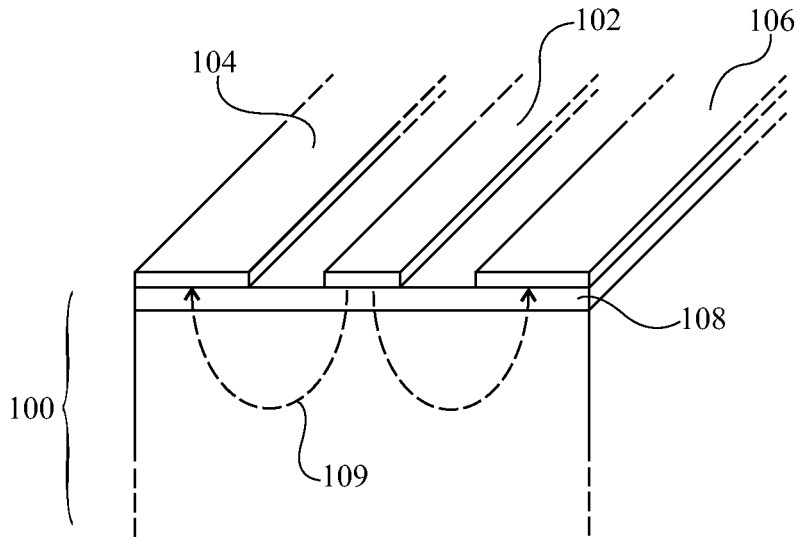
FIG. 1, previously described, shows a CPW-type transmission line.

According to simulations performed by the inventors on structures of the type in FIGS. 3A-3C, where the thickness of the BST layer was on the order of 400 nm, a phase shift on the order of 5° was obtained for a 5 V bias voltage for a line having a 60 μm length at a 60 GHz frequency. Similar simulations on a CPW line of the type in FIG. 1 have shown that a phase shift on the order of 0.15° was then obtained.

Thus, the tuning sensitivity of the S-CPW is at least 30 greater than that of the CPW line. This result may at least partly be imputed to the fact that, in the case of a CPW line, only a small part of the field lines, designated by arrows 109 in FIG. 1, runs through the BST, while in the case of a S-CPW line they only run through the BST and loop back in the conductive shielding plane.

In FIG. 3A, ferroelectric layer 10 has been shown as taking up the entire interval between the shielding plane and conductive strips 6, 8, and 9. This embodiment is likely to have many variations. For example, the ferroelectric layer does not necessarily go down all the way to the lower shielding plane and it may be coated with an interface layer before the deposition of metal strips 6, 8, and 9.

Figure 4:
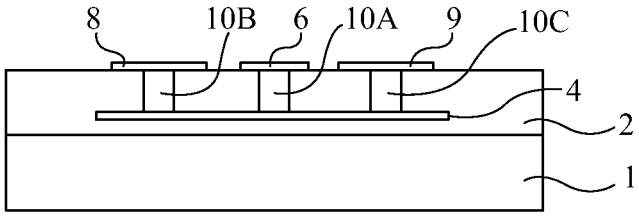
FIG. 4 is a cross-section view of a transmission line according to an embodiment of the present invention.

An alternative embodiment of ferroelectric layer 10 is shown in FIG. 4. In this variation, ferroelectric layer 10, instead of being present under all the conductive strips, is present by portions only under a portion of these conductive strips. More specifically, as shown in the drawing, a ferroelectric material portion 10A is arranged under strip 6 and ferroelectric material portions 10B and 10C are formed under strips 8 and 9.

According to other alternative embodiments, it may be provided for the ferroelectric material to only be present under the central strip or under the lateral strips. This may simplify the bias control circuit since it would then be sufficient to apply a biasing to the central strip or to the lateral strips.

The biasing variation between strip(s) 6, 8, 9 and shielding plane 4 will mainly result in modifying equivalent capacitance $C_{eq}$ of the transmission line. This causes a modification of characteristic impedance $Z=(L_{eq}/C_{eq})^{1/2}$ of the line, $L_{eq}$ being the equivalent inductance of the line. Correlatively, the phase speed of the propagation signal, $v_\phi=1/(L_{eq}\cdot C_{eq})^{1/2}$, will be modified, which results in a modification of the electric length of the line, $\theta=l(\omega/v_\phi)$, where l stands for the physical length of the transmission line and ω stands for the angular frequency of the signal.

$C_{eq}$ could be continuously modified by the application of variable potential differences between strip(s) 6, 8, 9 and shielding plane 4. However, it may be preferred to operate in all or nothing by applying potentials such that the equivalent capacitance takes one or the other of several predetermined values.

As seen previously, the possibility of modifying equivalent capacitance $C_{eq}$ results in a possibility of modifying the characteristic line impedance and the phase speed of a signal in the line. However, this does not enable to independently set the two parameters. To enable to independently tune the characteristic impedance and the phase speed, an embodiment of the present invention provides for the lateral distance between the lateral distance between the lateral ground strips and the central strip to be tunable, which mainly results in modifying equivalent inductance $L_{eq}$ of the line.

Figure 5A:
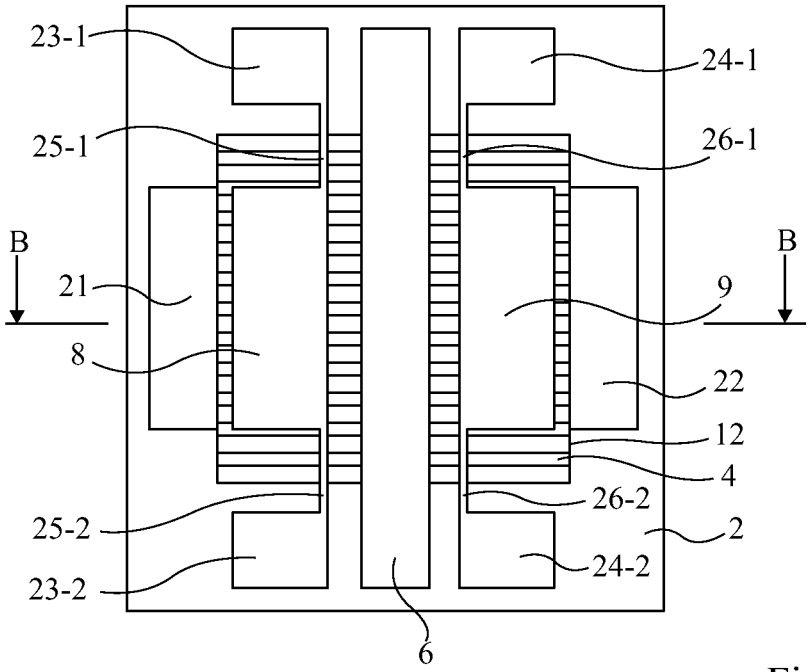
FIGS. 5A and 5B are a top view and a cross-section view of a transmission line according to an embodiment of the present invention.
Figure 5B:
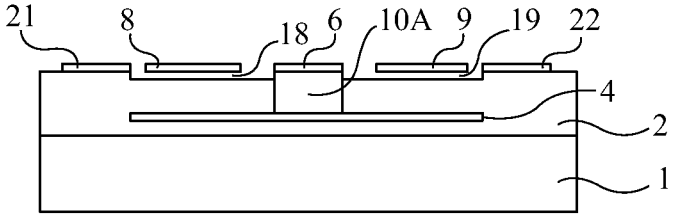

An embodiment of a structure enabling to obtain such an independent tuning is illustrated in FIGS. 5A and 5B which respectively are a top view and a cross-section view along plane B-B of FIG. 5A. FIGS. 5A and 5B will be collectively described hereafter.

The structure of FIGS. 5A and 5B is a variation of that described in relation with FIGS. 3A to 3C. It comprises shielding plane 4 and central strip line 6 surrounded with ground strips 8 and 9. An electric material 10A is arranged under central strip 6 only between this strip and shielding plane 4. A recess 18, 19 is formed under each of lateral strips 8 and 9 so that these strips can be laterally displaced under the effect of a voltage difference between them and external lateral electrodes 21, 22. Lateral strips 8 and 9 are connected to pads 23-1, 23-2, and 24-1, 24-2 respectively formed on insulator 2 by small blades 25-1, 25-2 and 26-1, 26-2. Blades 25-1, 25-2 and 26-1, 26-2 form a spring and enable ground strips 8 and 9 to displace when they are attracted by external electrodes 21, 22.

Stop systems may be provided to limit the displacement of the lateral strips and avoid a short-circuit between these strips and electrodes 21, 22 or central conductor 6. Such stops may for example be formed of insulating layers deposited on the lateral surfaces of the various elements.

During the operation of the structure of FIGS. 5A and 5B, once a biasing is applied, lateral strips 8 and 9 displace with respect to the central strip. This mainly results in modifying equivalent inductance $L_{eq}$ of the transmission line. $L_{eq}$ and $C_{eq}$, and thus Z and $v_{\phi}$ can thus be set independently.

The present invention is likely to have various alterations and modifications which will occur to those skilled in the art. Various means may be used to bias the central strip and the lateral strips with respect to the shielding plane and to displace the lateral strips with respect to the central strip.

The invention has been described in the context of a specific example of its application to a structure of S-CPW type. It should however be understood that it generally applies to other types of strip transmission lines having their parameters depending on the distance(s) between this strips and various ground planes.

As concerns the lateral displacement, various variations may also be used. In particular, attraction electrodes 21 and 22 and ground strips 8, 9 may be coupled by interdigited structures. Further, spring-forming blades 25-1, 25-2, 26-1, 26-2 may have various configurations, for example, meander shapes.

One of the advantages of the structure described herein is that it is effectively compatible with usual metallization level forming techniques generally used to form interconnects above a microelectronic integrated circuit.

As an illustrative example only, the following dimensions may be selected for a transmission line intended to operate at frequencies close to 60 GHz:

- strip width and distance between strips 6, 8, 9: approximately in the range from 7 to 15 μm,
- vertical distance between metallization levels: approximately in the in the range from 0.5 to 1 μm,
- distance between ground strips 8 and 9 and electrodes 21 and 22: approximately ranging from 0.5 to 2 μm.

With such values, the electrostatic displacement of the various elements can be controlled with voltages having values on the order of some ten volts, which may cause variations of the capacitance and inductance values by a factor on the order of from 1.5 to 3.

Various techniques may be implemented to form a transmission line such as described herein. For example, as concerns FIG. 5B, recesses 18, 19 under each of lateral strips 8 and 9 may be formed by forming on the surface of the structure a sacrificial layer before depositing metallizations 6, 8, and 9 and by removing this sacrificial layer once the metallizations have been formed. Further, concerning the structure of FIG. 5B, it may be provided for the ferroelectric layer to be more extended and to be covered with a sacrificial layer before the forming of conductors 6, 8, 9.

The invention claimed is:

1. A high-frequency transmission line comprising a central conductive strip associated with at least one conductive shielding plane, wherein at least a portion of the space between the conductive shielding plane and the conductive strip comprises a ferroelectric material, wherein the transmission line is of the slow wave coplanar waveguide type, comprising two lateral strips extending on either side of the central conductive strip and wherein the transmission line is associated with a voltage source for selectively biasing at least one of the central conductive strip and the lateral strips.

2. The transmission line of claim 1, wherein the ferroelectric material is BST.

3. The transmission line of claim 2, wherein the ferroelectric material has a thickness in the range from 0.4 to 1 μm.

4. The transmission line of claim 1, wherein the ferroelectric material extends under all or part of the central conductive strip and of the lateral strips.

5. The transmission line of claim 1, wherein the lateral strips have their central portions formed above recesses and are associated with lateral electrostatic displacement means.

6. A high-frequency transmission line comprising a central conductive strip associated with at least one conductive shielding plane, wherein at least a portion of the space between the conductive shielding plane and the conductive strip comprises a ferroelectric material, wherein the transmission line is of the slow wave coplanar waveguide type, comprising two lateral strips extending on either side of the central strip and wherein the lateral strips have their central portions formed above recesses and are associated with lateral electrostatic displacement means.

* * * * *